US005899155A

United States Patent [19]

Thorén

[11] Patent Number: 5,899,155

[45] Date of Patent: May 4, 1999

[54] MULTIPLE POSITION HOOP FOR EMBROIDERY SEWING

[75] Inventor: Willy Thorén, Huskvarna, Sweden

[73] Assignee: Viking Sewing Machines AB, Huskvarna, Sweden

[21] Appl. No.: 08/839,523

[22] Filed: Apr. 15, 1997

[30] Foreign Application Priority Data

May 29, 1996 [SE] Sweden ..... 9602067

[51] Int. Cl.[6] ..... D05C 1/02

[52] U.S. Cl. ..... 112/103

[58] Field of Search ..... 38/102, 102.2, 38/102.91; 112/102, 102.5, 103

[56] References Cited

U.S. PATENT DOCUMENTS

| | | | |
|---|---|---|---|
| 813,122 | 2/1906 | Trautmann . | |
| 1,159,901 | 11/1915 | Corrall et al. . | |
| 4,386,573 | 6/1983 | Davidson et al. | 112/103 |
| 4,762,076 | 8/1988 | Wakaizumi | 38/102.2 |
| 4,763,586 | 8/1988 | Takenoya et al. | 112/103 X |
| 5,353,725 | 10/1994 | Sakakibara | 112/103 |
| 5,630,370 | 5/1997 | Herbach | 112/103 |

FOREIGN PATENT DOCUMENTS

| | | |
|---|---|---|
| 602522 | 3/1926 | France . |
| 3820215 | 8/1989 | Germany . |
| 267671 | 7/1950 | Switzerland . |

*Primary Examiner*—Ismael Izaguirre
*Attorney, Agent, or Firm*—Pearne, Gordon, McCoy & Granger LLP

[57] ABSTRACT

A hoop for embroidery sewing comprises an outer frame (11) connected to a movable bracket (14), and an inner frame (10) adapted to be inserted into said outer frame for clamping a fabric to be embroidered therebetween. According to the invention, the outer frame has a guide device for slidably connecting the outer frame to the bracket, and the bracket has a latch device (16) for latching the outer frame in two or more predetermined positions relative to the bracket.

8 Claims, 3 Drawing Sheets

MULTIPLE POSITION HOOP FOR EMBROIDERY SEWING

BACKGROUND OF THE INVENTION

FIELD OF THE INVENTION

The present invention relates to a hoop for embroidery sewing, comprising an outer frame connected to a movable bracket, and an inner frame adapted to be inserted into the outer frame for clamping a fabric to be embroidered between said frames.

BACKGROUND INFORMATION

The hoop according to the invention is intended to be used in an embroidery machine, or a domestic sewing machine having an embroidery unit, for example of the kind described in Swedish patent application No. 9402710-9. Said embroidery unit has a drive assembly by which the hoop is slidable along an arm which in turn is slidable laterally, whereby the hoop is movable in mutually perpendicular directions. With such arrangement the range of movement of the hoop is relatively limited which restricts the size of the patterns that can be embroidered.

SUMMARY OF THE INVENTION

It is the object of the invention to provide a hoop which makes it possible to increase the working area for embroidery sewing without the need for alteration of the range of movement of the drive assembly. This object has been achieved by means of a hoop of the kind mentioned above, which according to the invention is characterized in that the outer frame has guide means for slidably connecting the outer frame to the bracket, said bracket having latch means for latching the outer frame in two or more predetermined positions relative to the bracket.

BRIEF DESCRIPTION OF THE DRAWINGS

The invention will be described in more detail in the following with reference to the accompanying drawings, in which.

DESCRIPTION OF THE PREFERRED EMBODIMENT

Figure 1:
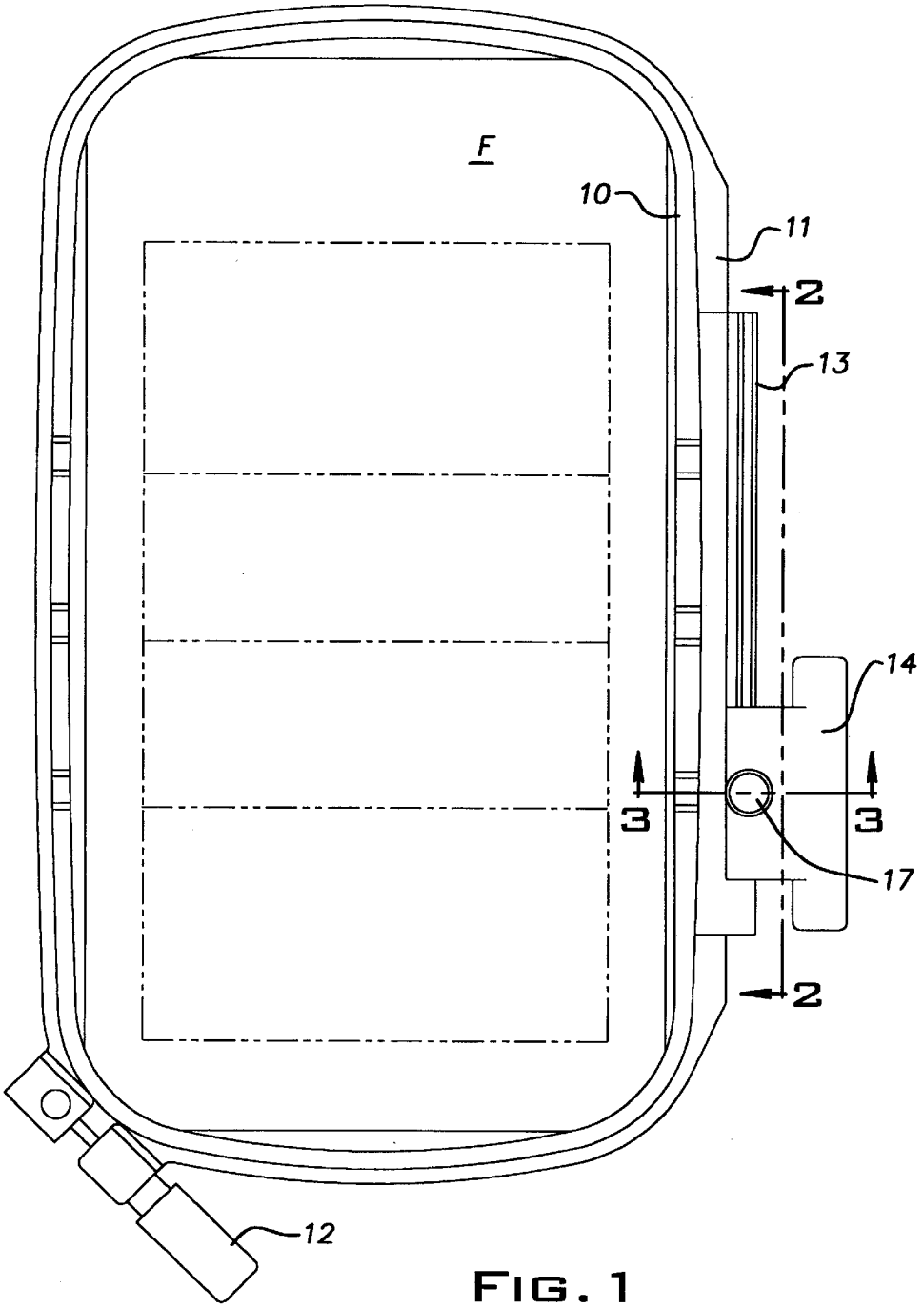
FIG. 1 shows a plan view of the hoop according to the invention.

The hoop illustrated in the drawings comprises an inner frame 10 and an outer frame 11, said last-mentioned frame having a tension screw 12 for the purpose of tensioning the outer frame around the inner frame, when a fabric F to be embroidered is clamped therebetween. At one of its long sides the outer frame has a longitudinal rail 13 which in the shown embodiment is made integral with the outer frame. Alternatively, the rail 13 could be made as a separate means attached to the outer frame by means of suitable fastening means, such as rivets. The rail 13 is slidable in a complementary groove of a bracket 14 which is in turn releasably attached to the drive assembly (not shown) of the embroidery unit.

Figure 2:
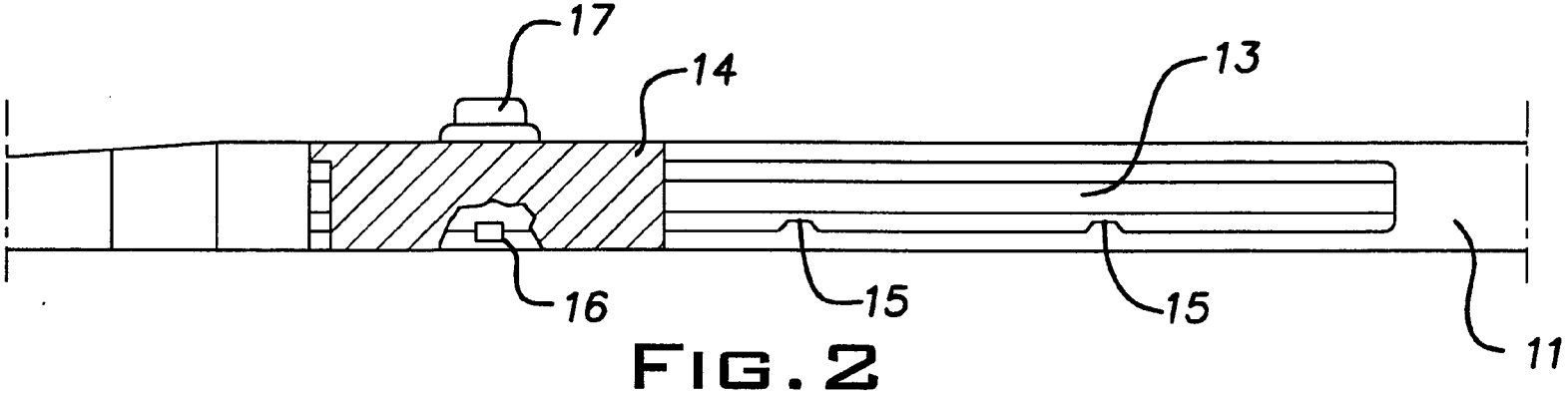
FIG. 2 is a side view of the same hoop, partially in section along line II—II in FIG. 1.

As shown in FIG. 2, the rail 13 is provided at its lower edge with notches 15 which are spaced at equal intervals. In the shown embodiment three such notches are provided on the rail 13. It should be noted, however, that other numbers of notches could also be used, and the number can thus be two or more. The bracket 14 has a latch 16 adapted to cooperate with the notches 15. The latch 16 is connected to a push-button 17 provided on the top side of the bracket and having a screw spring 18 (FIG. 3) which keeps the latch in engagement with one of the notches 15. By means of the push-button 17 the latch can be released such that the hoop can be slided relative to the bracket 14 and fixed in three predetermined positions corresponding to the notches 15 of the rail 13.

Figure 4:
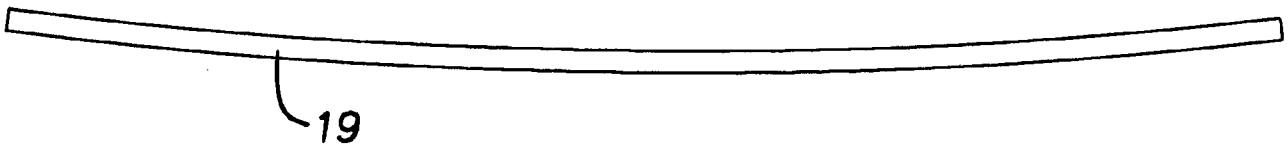
FIG. 4 is a side view of a leaf spring forming part of the hoop according to the invention.
Figure 3:
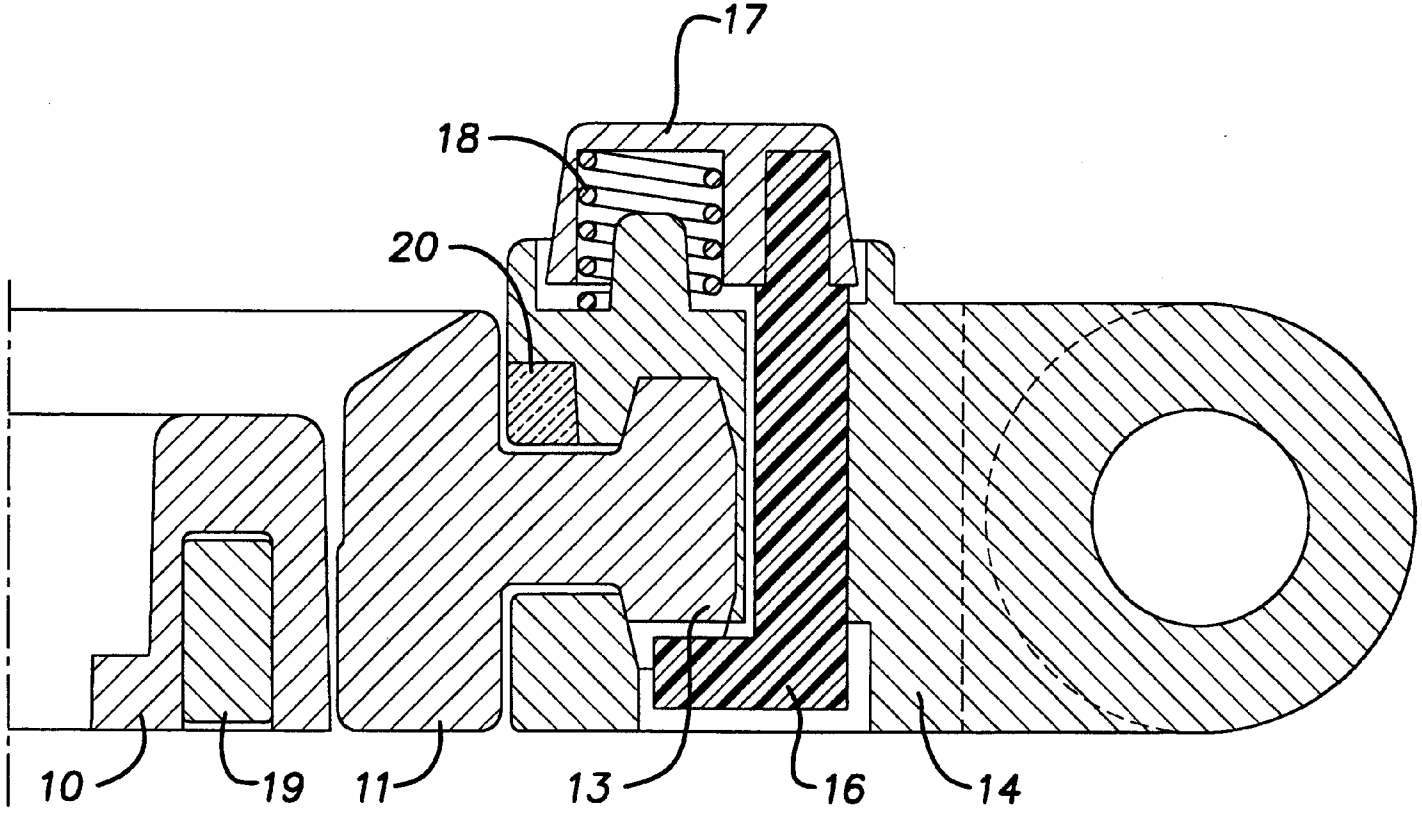
FIG. 3 is an enlarged cross-section taken along line III—III in FIG. 1.

It is a condition for obtaining proper holding of the fabric in the hoop that the inner and outer frames have a good fit. The inner frame is made relatively rigid whereas the outer frame, which is clamped around the inner frame by means of the screw 12, is more flexible. A suitable abutment between the two frames is thereby achieved. The side of the outer frame on which the rail 13 is mounted, however, is more rigid due to the stiffening function of the rail. In order to provide a proper abutment between the inner and outer frames on the mentioned side, the inner frame is provided with a leaf spring 19 which is shown in FIGS. 3 and 4. The spring 19 is mounted in the inner frame in a pretensioned condition in which the force of the spring is adapted to provide an appropriate abutment force between the inner and outer frames on this side of the hoop. A proper holding of the fabric is thereby achieved around the entire circumference of the hoop.

The different positions of the hoop are marked 1, 2 and 3 on the inner frame 10. When a first field of the fabric held in the hoop has been embroidered, the latch is released by means of the push-button 17 and the hoop is moved to a new position which enables embroidering of a further field. If necessary, the hoop is subsequently moved to the third position which allows the embroidered area to be increased by yet another field.

In connection with the movement of the hoop a corresponding adjustment of the control unit of the sewing machine takes place so as to provide a continuous embroidery pattern across the mentioned fields. The adjustment is preferably controlled by means of sensors 20 which are known per se provided in the bracket 14 for sensing the position of the hoop and emitting a corresponding signal to the control unit. When the embroidery of one field has been completed, it is also possible to provide an indication on the display of the sewing machine that the hoop must be moved before the embroidery operation can be continued.

By the hoop described above it is possible to increase the embroidered area substantially without altering the range of movement of the machine and without removing the fabric from the hoop.

I claim:

1. Hoop for embroidery sewing, comprising an outer frame (11) connected to a movable bracket (14), and an inner frame (10) adapted to be inserted into the outer frame for clamping a fabric to be embroidered between said frames, wherein the outer frame has guide means for slidably connecting the outer frame to the bracket, said bracket having latch means (16) for latching the outer frame in two or more predetermined positions relative to the bracket, repositioning of the outer frame from one of said predetermined positions to another of said predetermined positions being effective to increase a working area of the embroidery sewing, wherein the guide means comprises a rail (13)

movable in a complementary groove in the bracket (14) and having two or more notches (15) adapted to cooperate with said latch means.

2. Hoop according to claim 1, wherein the bracket (14) has means for sensing the position of the hoop and emitting a corresponding signal to a control unit of a sewing machine.

3. Hoop according to claim 1, wherein the inner frame (10) has a pretensioned leaf spring (19) on the side thereof facing the guide means, said leaf spring being adapted to press the inner frame towards the outer frame (11).

4. Hoop according to claim 1, wherein the inner frame has a pretensioned leaf spring on the side thereof facing the rail, said leaf spring being adapted to press the inner frame towards the outer frame.

5. Hoop for embroidery sewing, comprising an outer frame connected to a movable bracket, and an inner frame adapted to be inserted into the outer frame for clamping a fabric to be embroidered between said frames, said frames having a plurality of work fields, the outer frame having a guide means for slidably connecting the outer frame to the bracket, said bracket having a latch means for latching the outer frame in any one of a plurality of predetermined positions corresponding to the work fields, positioning of the frames relative to the bracket being effective to embroider in one of the work fields at a time, wherein the guide means comprises a rail movable in a complementary groove in the bracket and having two or more notches adapted to cooperate with said latch means.

6. Hoop according to claim 5, wherein the bracket has means for sensing the position of the hoop and emitting a corresponding signal to a control unit of a sewing machine.

7. Hoop according to claim 5, wherein the inner frame has a pretensioned leaf spring on the side thereof facing the guide means, said leaf spring being adapted to press the inner frame towards the outer frame.

8. Hoop according to claim 5, wherein the inner frame has a pretensioned leaf spring on the side thereof facing the rail, said leaf spring being adapted to press the inner frame towards the outer frame.

* * * * *